United States Patent [19]

Corris et al.

[11] 4,231,184

[45] Nov. 4, 1980

[54] REMOTE-CONTROL DOLL ASSEMBLY

[75] Inventors: Charles J. Corris, Irmo; Charles M. Hollingsworth, West Columbia; Witold W. Kosicki; Robert T. Potter, both of Columbia, all of S.C.

[73] Assignee: Horsman Dolls Inc., Columbia, S.C.

[21] Appl. No.: 813,499

[22] Filed: Jul. 7, 1977

[51] Int. Cl.[3] ..... A63H 11/00

[52] U.S. Cl. ..... 46/265; 46/118

[58] Field of Search ..... 46/17, 116–119, 46/264, 265, 256, 254, 266, 118; 40/457

[56] References Cited

U.S. PATENT DOCUMENTS

| | | | |
|---|---|---|---|
| 2,324,774 | 7/1943 | Henry | 40/457 X |
| 2,659,998 | 11/1953 | Cavanaugh | 46/264 |
| 2,990,646 | 7/1961 | Berger | 46/245 |
| 3,119,201 | 1/1964 | Brown et al. | 46/256 X |
| 3,229,421 | 1/1966 | Ostander | 46/264 |
| 3,230,661 | 1/1966 | Gleason | 46/175 R |
| 3,239,229 | 3/1966 | Freeman et al. | 46/232 |
| 3,266,187 | 8/1966 | Felsher | 46/264 |
| 3,293,795 | 12/1966 | Ryan | 46/118 |
| 3,413,756 | 12/1968 | Gardel | 46/117 |
| 3,514,899 | 6/1970 | Bonnano et al. | 46/264 |
| 3,546,814 | 12/1970 | Melendez | 46/254 |
| 3,566,537 | 3/1971 | Tepper et al. | 46/265 |
| 3,664,670 | 5/1972 | Glass et al. | 46/265 X |
| 3,918,199 | 11/1975 | DeMasi | 46/264 |
| 3,961,441 | 6/1976 | Sato | 46/256 |

FOREIGN PATENT DOCUMENTS

| | | | |
|---|---|---|---|
| 2527091 | 1/1977 | Fed. Rep. of Germany | 46/265 |

*Primary Examiner*—Gene Mancene
*Assistant Examiner*—Mickey Yu
*Attorney, Agent, or Firm*—Shenier & O'Connor

[57] ABSTRACT

A remote-control doll assembly in which a high-frequency sound signal produced by squeezing a toy baby bottle actuates an internal motor to raise the arms of the doll and actuates an internal voice mechanism to simulate a crying sound. Insertion of the nipple of the bottle into the mouth of the doll opens a switch to interrupt the crying sound. In an alternative embodiment, a radio signal is used as a control signal. In another modification of the invention, a pressure-sensitive rattle is used to produce the control signal.

2 Claims, 11 Drawing Figures

REMOTE-CONTROL DOLL ASSEMBLY

BACKGROUND OF THE DISCLOSURE

It is desirable to provide a toy doll that responds in a lifelike manner to external stimuli without using wires or any other apparent coupling medium. While remotely controlled human figures are known in the art, the control boxes used therewith are similar to those used in other remote-control systems and thus do not produce a natural or seemingly automatic response. Moreover, the external switches, knobs, and the like typically used are easily broken by a small child.

SUMMARY OF THE INVENTION

One of the objects of our invention is to provide a doll assembly in which the doll is controlled remotely.

Another object of our invention is to provide a doll assembly in which the doll is remotely controlled without the use of any wires or the like connecting the activating mechanism to the doll.

Still another object of our invention is to provide a doll assembly in which the doll responds in a seemingly natural manner to external stimuli.

Still another object of our invention is to provide a doll assembly which is sturdy and not easily broken.

Other and further objects will be apparent from the following description:

In general, our invention contemplates a remote-control doll assembly comprising a doll, a toy separate from the doll having pressure-sensitive means for producing a control signal, and means responsive to the control signal for actuating the doll to produce a lifelike response. The actuating means may energize a motor to raise the arms of the doll as well as energize a voice mechanism to simulating a crying sound.

BRIEF DESCRIPTION OF THE DRAWINGS

In the accompanying drawings to which reference is made in the instant specification and in which like reference characters are used to indicate like parts in the various views:

FIG. 8 is a schematic diagram of the electrical circuit of the doll of our remote-control doll assembly.

DETAILED DESCRIPTION OF THE PREFERRED EMBODIMENTS

Figure 1:
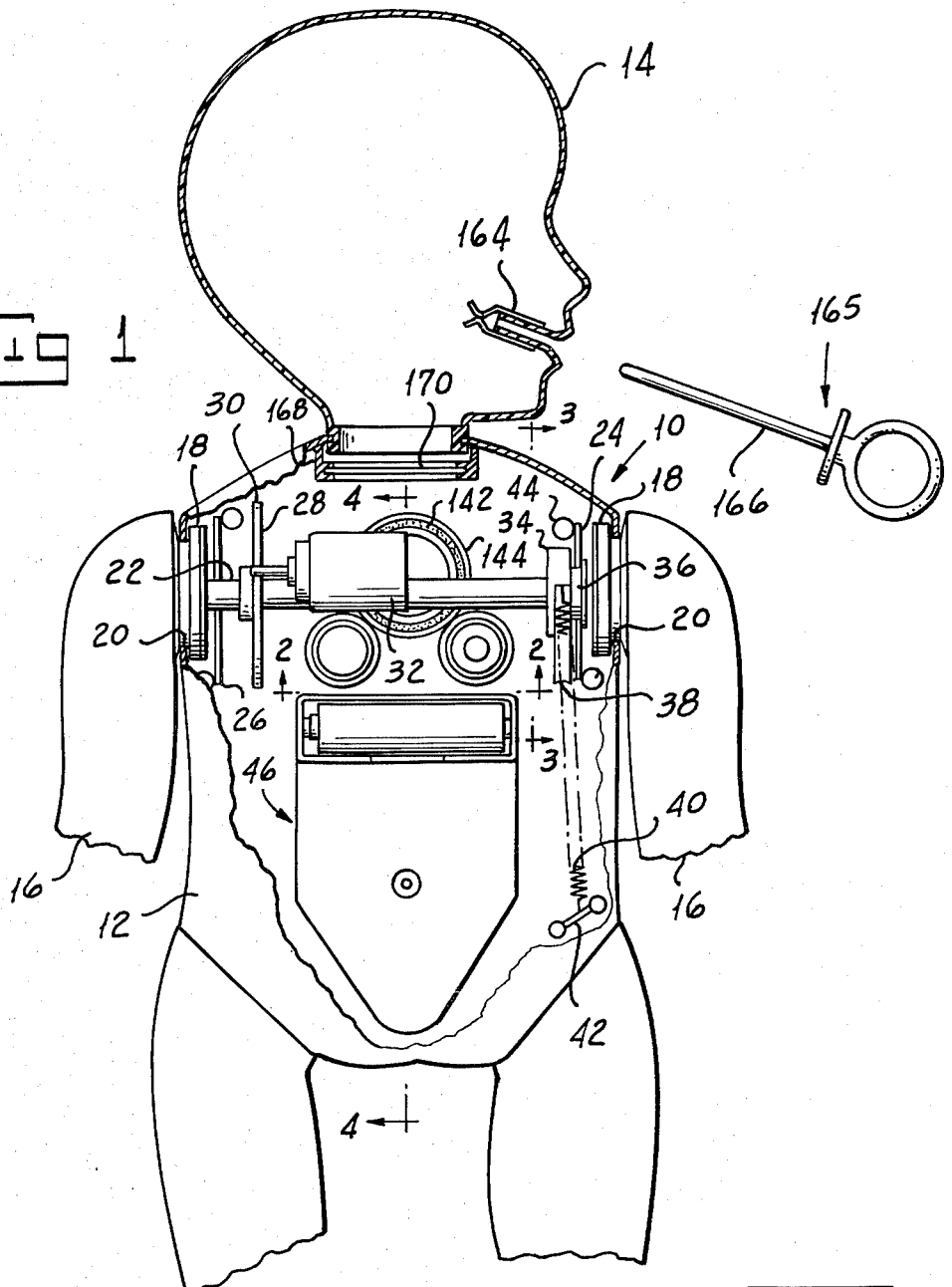
FIG. 1 is a fragmentary rear elevation of the doll used in one embodiment of our remote-control doll assembly.

Referring now to FIGS. 1 to 8, our doll, indicated generally by the reference character 10, includes a torso 12 comprising a rubber or plastic skin and a head 14 rotatably received by the torso 12. The doll 10 includes a pair of movable arms 16, each of which has a flange 18 received by a respective arm hole 20 formed in the torso 12. A shaft 22 extending transversely inside the torso 12 couples the arms 16 so that they swing together upwardly or downwardly. Respective left and right shaft supports 24 and 26 define an axis of rotation for the shaft 22. Shaft 22 carries a friction wheel 28 having an outer friction surface 30 comprising rubber or the like. A motor 32, the shaft of which bears against the friction surface 30, is energized in a manner to be described to rotate the shaft 22 to swing the arms 16 upwardly. Motor 32 may be fixedly mounted inside the torso 12 or, if desired, biased against the friction wheel 28 by means of a spring or the like (not shown). Motor 32 is coupled to a common or ground line 31 and a "hot" line 33 (FIG. 8). We secure one end of a tension spring 40 to a bracket 42 and the other end to a peripherally grooved semicircular counterbalance wheel 38 having a hub 34 carried by shaft 22. This spring 40 wraps around wheel 38 in the lowered position of the arms 16 and tends to counterbalance the weight of the arms to ease the load on motor 22. A limit stop 44, which the edges of wheel 38 abut if it rotates sufficiently far in either direction, limits the rotation of arms 16 to about 120° to approximate the angular sweep of an actual arm. Hub 34 is coupled to the shaft 22 through a friction clutch 36 to prevent breakage if the arms are rotated beyond a point at which the wheel 38 abuts the limit stop 44.

Figure 5:
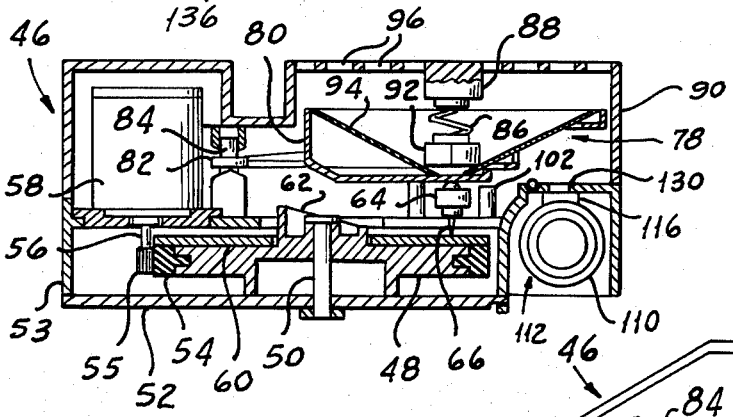
FIG. 5 is a section of the voice unit of the doll of our remote-control doll assembly.
Figure 6:
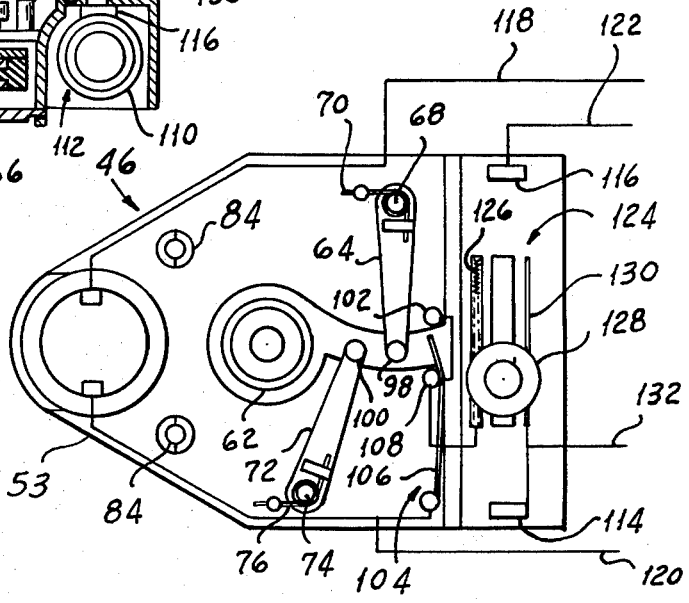
FIG. 6 is a top plan of the voice unit shown in FIG. 5, with parts removed.
Figure 3:
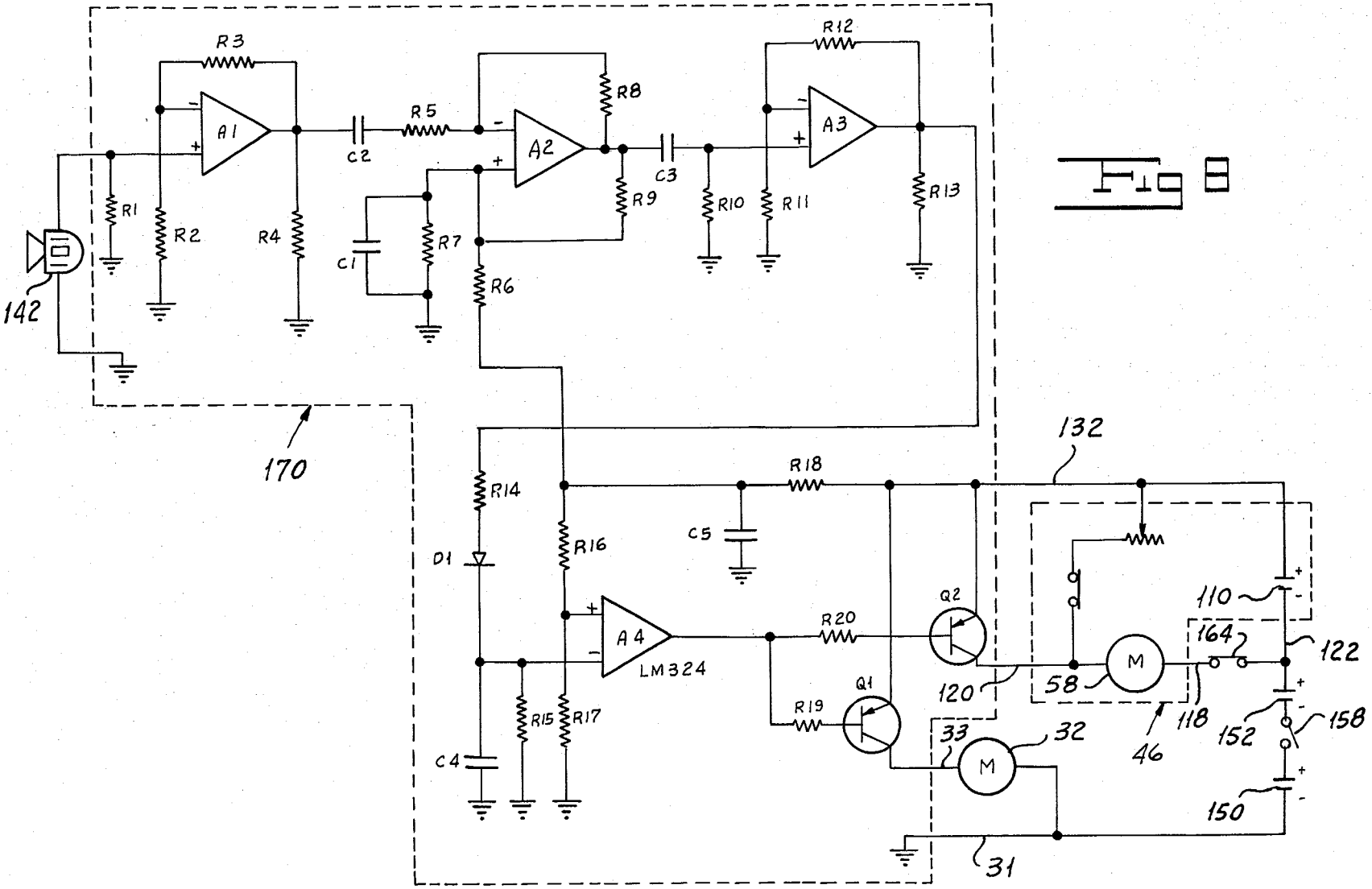

Our doll 10 also carries a voice unit, indicated generally by the reference character 46. Referring particularly now to FIGS. 5 and 6, the voice unit 46 comprises a turntable 48 carried by a spindle 50 rotatably supported by a bottom wall 52 secured to the lower housing 53. A grooved roller 55 mounted on the shaft 56 of a motor 58 supported by the lower housing 53 bears against a friction rim 54 of the turntable 48 to drive it. If desired, rather than directly driving the turntable 48, it is also possible to drive the turntable with a rubber belt or the like. Turntable 48 carries a phonograph disc 60 on which is recorded a crying sound or other suitable material. An upwardly projecting cylindrical portion of the turntable centers the disc 60. We form this turntable portion with a cam 62 for a purpose to be described.

A player arm 64, pivotally supported at one end by a pivot 68, carries a needle 66 at its free end. Player arm 64 is mounted on a portion of the lower housing 53 in such a position that the needle 66 traverses the disc 60 as the arm 64 swings on the pivot 68. A torsion spring 70 urges the player arm 64 outwardly away from the cammed surface 62 at the center of the turntable 48. A follower arm 72, pivotally supported at one end by a pivot 74, is so disposed on the lower housing 53 that the free end of the arm 72 bears outwardly against the arm 64. A torsion spring 76 urges follower arm 72 against the player arm 64.

A speaker assembly, indicated generally by the reference character 78, comprises a frame 80. Eyelets 82 formed at the ends of extensions of the frame 80 fit around posts 84 carried by the lower housing 53 to provide pivoting movement of the entire speaker assembly 78 about a horizontal pivot axis. A spring 86 disposed between a fixed support 88 carried by upper housing 90 and a floating support 92 resting on a speaker cone 94 urges the speaker assembly 78 downwardly so that a flat portion of the frame 80 abuts respective bosses 98 and 100 formed on the upper surfaces of the free ends of arms 64 and 72. In this manner the needle 66 is urged against the groove walls of the disc 60. Mechanical vibrations picked up by the needle 66 are transmitted directly to the speaker cone 94 through the arm 64 and the frame 80. Perforations 96 formed in the upper housing 90 above the speaker cone 94 permit the speaker 94 to radiate sound freely.

The rotation of the turntable 54 carries the arms 64 and 72 inwardly toward the center of the turntable until the follower arm 72 engages the cammed upper surface 62, which raises the arm 72 against the speaker assembly frame 80. This lifts the entire speaker assembly 78 upward, removing the downward force from the player arm 64 to permit the torsion spring 70 to return it to an outer limit position defined by a limit stop 102. In this manner, the arm 64 is automatically reset to an outer position away from the center of the turntable 54 at the end of a play.

A conductive feeler 106 bears against a post 108 disposed at the periphery of the turntable 48 to provide a normally closed switch indicated generally by the reference character 104. Player arm 64 bears against feeler 106 to open switch 104 between plays when spring 70 urges the arm against the limit stop 102. One terminal of switch 104, together with one terminal of the motor 58, is coupled to an external line 120. We dispose a 1.5 volt battery 110 in a battery compartment, indicated generally by the reference character 112, between a positive contact 114 and a negative contact 116. The positive contact 114 is connected to an external line 122, while the negative contact 116 is coupled to another external line 132 and to a rheostat indicated generally by the reference character 124. Rheostat 124 comprises a metal slider 128 movable along a resistance coil 126 and a wire 130. The other terminal of rheostat 124 is coupled to one terminal of the switch 104. The other terminal of switch 104, together with one terminal of motor 58, is coupled to an external line 120. The other terminal of motor 58 is coupled to an external line 118.

Figure 4:
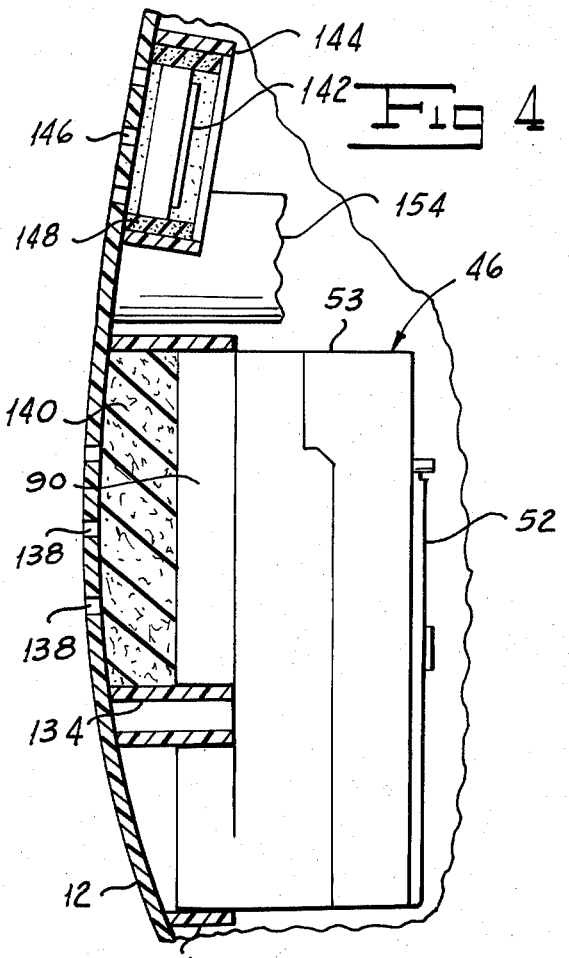
FIG. 4 is a fragmentary section, taken along line 4—4 of FIG. 1, showing the mounting of the microphone and voice unit of our remote-control doll assembly.

A cylindrical speaker receptacle 134 and a cylindrical motor receptacle 136 carried by the ventral portion of the torso 12 receive the upper portion of the voice unit 46 as shown in FIG. 4 so that the bottom wall 52 faces the rear of the doll. Preferably, a foam rubber pad 140 is disposed between the speaker portion of the player unit 46 and the wall of the torso 12, and the portion of the torso wall 12 adjacent the foam pad 140 provided with perforations 138 to permit satisfactory radiation of sound. In a similar manner we dispose a crystal microphone 142 within a cylindrical microphone receptacle 144 carried by the chest portion of the torso 12. Preferably, a foam rubber ring 148 isolates the microphone from the receptacle 144. Perforations 146 in the adjacent wall portion of the torso 12 allow the microphone 42 to pick up sounds from the environment.

Figure 2:
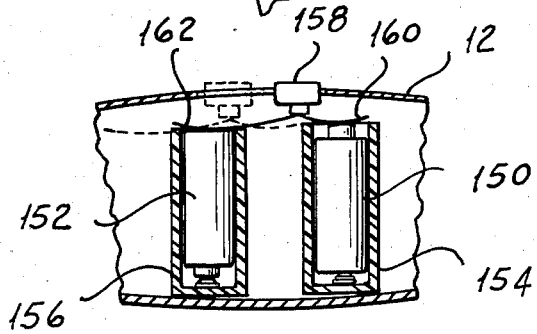
FIG. 2 is a fragmentary section, taken along line 2—2 of FIG. 1, showing the battery compartments and main switch of the doll of our remote-control doll assembly.
Figure 3:
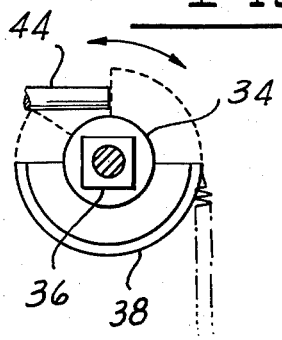
FIG. 3 is a fragmentary section, taken along line 3—3 of FIG. 1, showing the counterbalance wheel and clutch of the doll of our remote-control doll assembly.

Referring to FIGS. 1, 2 and 8, a pair of 1.5 volt batteries 150 and 152 are housed in respective cylindrical battery compartments 154 and 156 carried by the front portion of the torso 12. A slide switch 158 having contacts 160 and 162 is movable across the back of the torso 12 between a first position in which contacts 160 and 162 connect batteries 150 and 152 and a second position, shown in dotted lines in FIG. 2, in which the connection between the batteries 150 and 152 is broken. Battery 150 has its negative terminal coupled to line 31, while battery 152 has its positive terminal coupled to line 122. We also mount a switch 164 coupling lines 118 and 122 in the mouth of the doll 10. The contacts of switch 164 are normally closed but are opened in response to insertion of the stem 166 of a pacifier indicated generally by the reference character 165.

A slotted receptacle 168 mounted just below the neck of the doll slidably receives a printed circuit board 170. Circuit board 170 produces control signals for the arm motor 32 and the voice unit motor 58 in response to sound waves having a frequency of approximately 14 kHz. Referring now particularly to FIG. 8, we connect microphone 142 and an input resistor R1 in parallel between the ground, or common, line of circuit board 170 and the noninverting input of a first operational amplifier A1 to cause the amplifier to produce an output across resistor R4. A portion of the output of operational amplifier A1 is fed back to the inverting input through a voltage divider comprising an upper resistor R3 and a lower resistor R2. We feed the output of amplifier A1 to the inverting input of a sound operational amplifier A2 through series-connected capacitor C2 and resistor R5. We couple the output of amplifier A2 to the inverting input through a resistor R8 and to the noninverting input through a resistor R9. We connect a resistor R7 and a capacitor C1 in parallel between the noninverting input and ground. A resistor R6 connects the noninverting input to a positive DC supply line filtered by a capacitor C5. A resistor R18 couples capacitor C5 to line 132.

In the circuit so far described, operational amplifier A1 functions as a noninverting voltage amplifier whose gain is determined by the ratio of the resistance of resistor R3 to that of resistor R2. Amplifier A2 and its associated circuitry function as an active bandpass filter having a passband frequency of 14 kHz corresponding to the frequency of the actuating sound signal. The values of components R5, C2, R7 and C1 determine the passband frequency of the filter, while the values of R8 and R9 determine the gain and selectivity of the active filter. Such a filter is desirable to discriminate against spurious sound signals which may otherwise inadvertently actuate motors 32 and 58. A capacitor C3 and an input resistor R10 couple the output of amplifier A2 to the noninverting input of a third operational amplifier A3 to produce an output across resistor R13. A portion of the output of amplifier A3 is fed back to the inverting input through a voltage divider comprising resistors R11 and R12. A series-connected diode D1 and resistor R14 apply the output of amplifier A3 to the inverting input of amplifier A4. We connect a timing circuit comprising parallel-connected resistor R15 and capacitor C4 between the inverting input to amplifier A4 and ground.

In response to an audio signal at its noninverting input, amplifier A3 provides a detected DC signal across resistor R15 and capacitor C4. Resistor R15 and capacitor C4 are so selected as to have a suitable time constant for operation of the motors 32 and 58. In the circuit described, a time constant of 0.5 second is used. The detected signal is applied to the inverting input of the fourth operational amplifier A4. A voltage divider comprising resistors R16 and R17, coupled across the positive voltage supply filtered by capacitor C5, provides a reference biasing voltage applied to the noninverting input of amplifier A4. Amplifier A4 thus normally provides a highly positive signal, but provides a signal approaching ground potential in response to a detected DC signal across capacitor C4. Respective resistors R19 and R20 couple the output of amplifier A4 to the bases of transistors Q1 and Q2. We connect the collector of transistor Q1 to the hot line 33 of motor 32, the other terminal of which is connected to ground line 31. We connect the collector of transistor Q2 to line 120 running to one terminal of the player unit motor 58. The other terminal of motor 58 is connected to the negative terminal of battery 110 through line 118 and switch 164. A line 132 supplies the emitters of transistors Q1 and Q2 with a potential of +4.5 volts.

In the absence of a 14 kHz audio signal, amplifier A4 provides a positive output to cut off transistors Q1 and Q2. In response to an audio signal, the output of amplifier A4 drops nearly to ground potential, driving transistors Q1 and Q2 into saturation and energizing the motors 32 and 58. Because of the time constant provided by capacitor C4 and resistor R15, motor 32 remains on for about two seconds, a sufficient time to raise arms 16 through the 120° arc defined by limit stop 44. Friction clutch 34 allows the arm 16 to be moved manually beyond these limits without breakage.

Energization of the voice unit motor 58 rotates the turntable 54 to draw the player arm 64 toward the center of the turntable 54 along the spiral groove of the disc 60. Circuit board 170 energizes the motor 58 for a sufficient period of time that arm 64 disengages the switch 104 to energize motor 58 through rheostat 124 and switch 104. Thus, when transistor Q2 turns off after about two seconds, the voice unit 46 continues to operate. At the end of the play, player arm 64 is moved back against switch 104 to turn the unit 46 off. The playing of disc 60 may also be interrupted at any time by inserting the pacifier 165 into the doll's mouth to open the switch 164.

Figure 7:
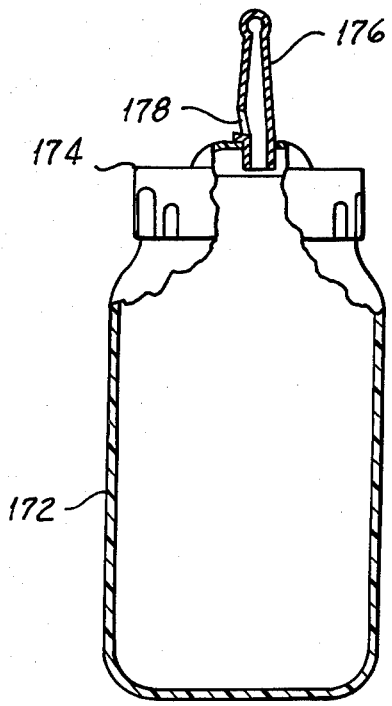
FIG. 7 is a side elevation, shown partly in section, of the bottle used to produce a control signal in our remote-control doll assembly.

Referring to FIG. 7, we show a toy baby bottle used to generate sound of 14 kHz. The bottle assembly comprises a soft, hollow, low-density polyethylene bottle 172 having a hollow interior and a cap 174 fitted with a sound whistle 176. Sound whistle 176, which is shaped like a nipple, communicates with the interior of the bottle 172 and has an exit aperture 178. The interior of the whistle 176 is so shaped as to produce a sound of approximately 14 kHz whenever the bottle 172 is lightly squeezed. Microphone 142 picks up this sound to actuate the motors 32 and 58 in the manner previously described. If desired, the whistle 176 may be so shaped that it fits inside the doll's mouth to open the switch 164 and thus replace the pacifier 165.

Figures 9, 10, 11:
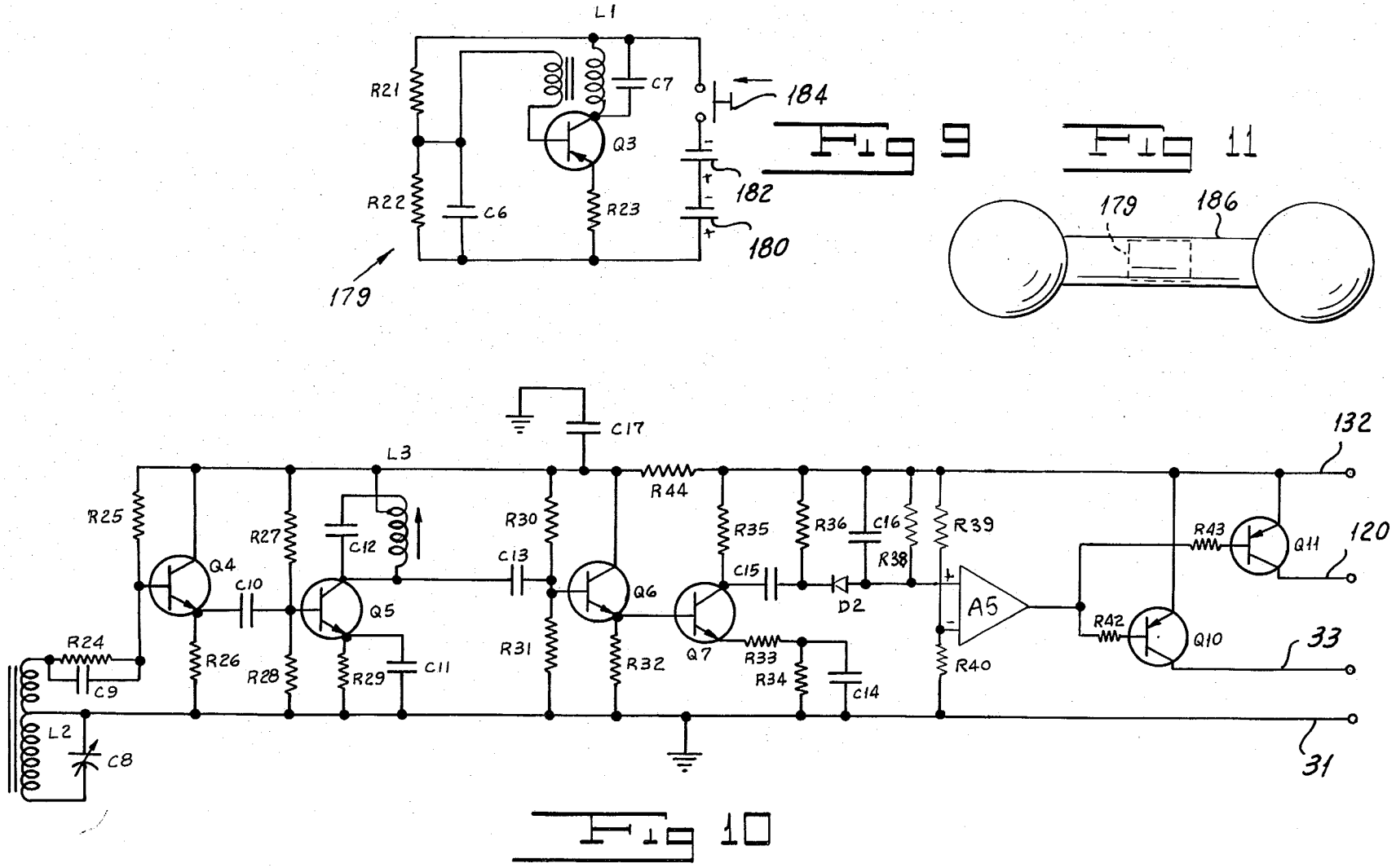
FIG. 9 is a schematic diagram of the radio transmitter used in an alternative embodiment of our doll assembly.
FIG. 10 is a schematic diagram of the radio receiver responsive to the transmitter shown in FIG. 9.
FIG. 11 is a side elevation of a rattle used to generate a control signal in an alternative embodiment of our remote-control doll assembly.

Referring now to FIGS. 9 and 10, we show portions of an alternative embodiment in which the sound whistle 176 and circuit board 170 are replaced by a radio-frequency transmitter and receiver operating at a frequency of about 300 kHz. In the transmitter circuit indicated generally by the reference character 179, a transmitter Q3 is used in a common-emitter configuration in which the supply voltage is provided by a pair of series-connected cells 180 and 182 controlled by a push-actuated switch 184. The transmitter may, for example, be disposed inside of a squeeze bottle such that squeezing of the bottle closes the switch 184. We connect the primary winding of a transmitter coil L1 in parallel with a capacitor C7 between the collector of transistor Q3 and the negative supply line to form a resonant tank circuit. The secondary winding of transmitter coil L1 is coupled between the base of transistor Q3 and a DC biasing circuit comprising series resistors R21 and R22 and bypass capacitor C6 across R22. The biasing circuit also comprises a resistor R23 coupled between the emitter of transistor Q3 and the positive supply line. The polarities of the windings of transmitter coil L1 are so arranged that the collector circuit of transistor Q3 provides regenerative feedback to the base of the transistor to produce substantially sinusoidal oscillations having a frequency of 300 kHz.

Referring now to the receiver circuit shown in FIG. 10, a ferrite pickup coil L2 has a tap connected to the external line 31. A tuning capacitor C8 connected between the tap and one end of coil L2 is adjustable to the transmitting frequency of 300 kHz. Parallel-connected resistor R24 and capacitor C9 couple the other end of coil L2 to the base of a transistor Q4. We connect resistors R25 and R26 between the base of transistor Q4 and a positive supply line filtered by capacitor C17 and between the emitter of transistor Q4 and ground to complete the biasing circuit of transistor Q4.

Transistor Q4 is used as an emitter follower in which the collector runs to the positive supply and the emitter is coupled to base of transistor Q5 through a capacitor C10. Resistors R27 and R28 across the voltage supply and resistor R29 in parallel with the capacitor C11 between the emitter and ground bias transistor Q5. We dispose a tank circuit comprising a capacitor C12 and an adjustable inductor L3 between the collector of transistor Q5 and the positive supply line.

The collector of transistor Q5 drives the base of another transistor Q6 through a capacitor C13. A voltage divider comprising R30 and R31 and a load resistor R32 coupled between the emitter and ground bias transistor Q6. A resistor R44 connects the collector of transistors Q4, Q5 and Q6 to line 132 which, as in the circuit shown in FIG. 8, is at +4.5 volts relative to amplifier ground.

The emitter of transistor Q6 drives the base of transistor Q7 directly. A load resistor R35 connects the collector of transistor Q7 to line 132. A circuit made up of a resistor R33 in series with parallel-connected resistor R34 and capacitor C14 leads from the emitter of transistor Q7 to ground. A capacitor C15 couples the collector of transistor Q7 to a resistor R36 leading to supply line 132. A diode D2 connects a parallel RC circuit made up of a resistor R38 and a capacitor C16 and leading from line 132 to capacitor C15. This RC circuit provides a suitable time constant in manner analogous to that of R15 and C4 in FIG. 8.

Diode D2 is so oriented as to provide a potential at its terminal with capacitor C16 which is negative relative to line 132. Diode D2 drives the noninverting input of an operational amplifier A5, the inverting input of which is derived from a voltage divider comprising resistors R39 and R40. The output of amplifier A5 feeds the bases of power transistors Q10 and Q11 through respective current-limiting resistors R42 and R43. Transistors Q10 and Q11 each have their emitters coupled to the positive supply line 132 and have their collectors coupled to respective lines 33 and 120 in a manner similar to transistors Q1 and Q2 of the embodiment shown in FIG. 8.

Transistors Q4, Q5, Q6 and Q7 amplify the received radio signal to a suitable level for detection. In the absence of such a radio signal, the potential across resistor R35 remains more or less constant so that the noninverting input of amplifier A5 remains at a potential near that of line 132. Since this input is thus more positive than that provided by resistors R39 and R40, amplifier A5 provides a positive output to render transistors Q10 and Q11 nonconductive. When a signal is transmitted, an amplified alternating potential is developed across resistor R35. The potential is rectified by diode D2 to produce a filtered signal across capacitor C16. With the noninverting input to amplifier A5 now more negative than the inverting input, amplifier A5 provides an output near ground potential to turn on transistors Q10 and Q11 to energize motors 32 and 58, in a manner similar to that of the circuit shown in FIG. 8. If desired, a circuit comprising discrete components, such as a common-emitter transistor stage directly driving an emitter-follower stage, may be used instead of operational amplifier A5 to drive transistors Q10 and Q11.

While we have shown in FIG. 7 a squeezable baby bottle which may be used to generate either a sound signal or a radio signal, it is not necessary that this particular means be used. In general, any toy having a pressure-sensitive means may be used to produce a control signal. In FIG. 11, we show an alternative embodiment comprising a squeezable rattle 186 in which the radio frequency transmitter 179 is disposed such that gripping of the rattle 186 closes the switch 184. If desired, rather than disposing a radio frequency transmitter in the rattle 186 as shown, a sound whistle similar to the whistle 176 shown in FIG. 7 may also be suitably disposed inside the rattle 186.

It will be seen that we have accomplished the objects of our invention. In response to a remote signal produced from a toy rattle or baby bottle, for example, our doll raises its arms and produces a crying sound to simulate a natural response to an external stimulus. Our doll stops crying in response to the insertion of the baby bottle or a pacifier into its mouth, thus enhancing the naturalness of its response. Our system controls the doll remotely and without wires connecting the actuating device to the doll. Because no external switches or the like are used to turn on the control signal, the control devices are relatively unbreakable.

It will be understood that certain features and subcombinations are of utility and may be employed without reference to other features and subcombinations. This is contemplated by and is within the scope of our claims. It is further obvious that various changes may be made in details within the scope of our claims without departing from the spirit of our invention. It is, therefore, to be understood that our invention is not to be limited to the specific details shown and described.

Having thus described our invention, what we claim is:

1. A remote-control-doll assembly including in combination a doll having arms and means for rotatably receiving said arms, a toy separate from said doll, selectively operable means on said toy for radiating a control signal, and means on said doll responsive to said control signal for actuating said doll to simulate a human action, said actuating means comprising a motor having a shaft, means for coupling said motor shaft to said arms, means responsive to said control signal for energizing said motor, an additional shaft coupled to at least one of said arms, a wheel carried by said additional shaft having a grooved rim, a fixed limit stop disposed so as to abut said wheel at the limits of a predetermined arc to limit the angular movement of said arms, and a spring having one end secured to said wheel, said spring wrapping around said rim as said additional shaft is rotated to exert a torque on said shaft.

2. A remote-control doll assembly including in combination a doll having portions forming a mouth, a squeezable baby bottle separate from said doll, said bottle comprising a nipple portion, selectively actuable means on said bottle for radiating a control signal, means on said doll responsive to said control signal for actuating said doll to simulate a human action, and means responsive to insertion of said nipple portion into said mouth for disabling said actuating means.

* * * * *